US007784705B2

(12) United States Patent
Kasper et al.

(10) Patent No.: US 7,784,705 B2
(45) Date of Patent: Aug. 31, 2010

(54) CONTROLLER WITH DYNAMIC TEMPERATURE COMPENSATION

(75) Inventors: Gary P. Kasper, Champlin, MN (US); Gary A. Smith, Plymouth, MN (US); Paul C. Wacker, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 1222 days.

(21) Appl. No.: 11/276,391

(22) Filed: Feb. 27, 2006

(65) Prior Publication Data

US 2007/0200004 A1 Aug. 30, 2007

(51) Int. Cl.
*G05D 22/02* (2006.01)
*F25B 49/00* (2006.01)

(52) U.S. Cl. ..... 236/44 C; 236/46 C; 62/157; 62/176.6

(58) Field of Classification Search ..... 236/1 C, 236/44 C, 46 C; 374/1; 62/176.6, 157, 231
See application file for complete search history.

(56) References Cited

U.S. PATENT DOCUMENTS 3,948,441 A 4/1976 Perkins et al.
3,988,708 A 10/1976 Thorsteinsson et al.
4,001,752 A 1/1977 Hazleton
4,008,454 A 2/1977 Bowling
4,075,594 A 2/1978 Tomoyoshi
4,095,740 A 6/1978 Wirth
4,154,397 A 5/1979 Carlson
4,172,555 A 10/1979 Levine
4,181,957 A 1/1980 Pinckaers
4,240,077 A 12/1980 Hughes et al.
4,241,872 A 12/1980 Frankenberg
4,248,375 A 2/1981 Whitney
4,283,701 A 8/1981 Ryckman, Jr.
4,319,711 A 3/1982 Barker et al.
4,332,352 A 6/1982 Jaeger
4,341,345 A 7/1982 Hammer et al.
4,358,667 A 11/1982 Johnson et al.
4,373,664 A 2/1983 Barker et al.
4,387,763 A 6/1983 Benton
4,399,428 A 8/1983 Hughes et al.
4,448,033 A 5/1984 Briccetti
4,460,125 A 7/1984 Barker et al.
4,480,174 A 10/1984 Hummel
4,577,977 A 3/1986 Pejsa
4,606,401 A 8/1986 Levine et al.
4,632,177 A 12/1986 Beckey (Continued)

OTHER PUBLICATIONS

Prior Art Heat Compensation Techniques for Thermostats That Existed Prior to Feb. 27, 2006, 1 page, created on Oct. 2, 2006.

*Primary Examiner*—Marc E Norman
(74) *Attorney, Agent, or Firm*—Crompton Seager & Tufte LLC

(57) ABSTRACT

An electronic device such as an HVAC controller that accounts for internal heating in determining an environmental condition such as temperature or humidity in the space surrounding the HVAC controller. The HVAC controller may calculate a transient heat rise value that is based upon a powered time period and a first order time lag, especially during a time period before which the HVAC controller reaches a steady state temperature condition.

24 Claims, 8 Drawing Sheets

U.S. PATENT DOCUMENTS 4,641,012 A 2/1987 Roberts
4,695,942 A 9/1987 Levine et al.
4,703,298 A 10/1987 Gerson
4,730,941 A 3/1988 Levine et al.
4,741,476 A 5/1988 Russo et al.
4,746,785 A 5/1988 De Longhi
4,776,514 A 10/1988 Johnstone et al.
4,793,553 A 12/1988 Berman
4,829,458 A 5/1989 Russo et al.
RE32,960 E 6/1989 Levine
4,837,731 A 6/1989 Levine et al.
4,841,458 A 6/1989 Levine et al.
4,864,513 A 9/1989 Levine et al.
4,910,966 A 3/1990 Levine et al.
4,916,912 A 4/1990 Levine et al.
4,951,473 A 8/1990 Levine et al.
4,974,417 A 12/1990 Levine et al.
4,974,418 A 12/1990 Levine et al.
5,025,242 A 6/1991 Holtkamp et al.
5,025,984 A 6/1991 Bird et al.
5,039,010 A 8/1991 Juntunen
5,088,806 A 2/1992 McCartney et al.
5,105,366 A 4/1992 Beckey
5,170,752 A 12/1992 Binversie et al.
5,197,668 A 3/1993 Ratz et al.
5,199,637 A 4/1993 Adams
5,203,497 A 4/1993 Ratz et al.
5,219,119 A 6/1993 Kasper et al.
5,269,458 A 12/1993 Sol
5,270,952 A 12/1993 Adams et al.
5,361,983 A 11/1994 Bird
5,410,230 A 4/1995 Bessler et al.
5,461,372 A 10/1995 Busak et al.
5,542,279 A 8/1996 Erdman et al.
5,542,285 A * 8/1996 Merilainen et al. ..... 73/23.21
5,552,956 A 9/1996 Pasquarette et al.
5,555,927 A 9/1996 Shah
5,574,421 A 11/1996 Hickling
5,615,829 A 4/1997 Porter
5,659,285 A 8/1997 Takeda
5,758,407 A 6/1998 Hickling
5,795,112 A * 8/1998 Senda ..... 409/131
5,812,061 A 9/1998 Simons
5,839,654 A 11/1998 Weber
5,950,709 A 9/1999 Kruegger et al.
6,044,808 A 4/2000 Hollis
6,169,937 B1 1/2001 Peterson
6,189,798 B1 2/2001 Sano et al.
6,208,905 B1 3/2001 Giddings et al.
6,487,457 B1 11/2002 Hull et al.
6,502,238 B1 12/2002 Pavan et al.
6,505,781 B2 1/2003 Altman
6,536,678 B2 3/2003 Pouchak
6,595,430 B1 7/2003 Shah
6,598,056 B1 7/2003 Hull et al.
6,621,507 B1 9/2003 Shah
6,647,302 B2 11/2003 Pouchak
6,694,927 B1 2/2004 Pouchak et al.
6,728,600 B1 4/2004 Contaldo et al.
6,804,169 B2 10/2004 Addy et al.
6,851,621 B1 2/2005 Wacker et al.
6,938,432 B2 9/2005 Enomoto
7,364,353 B2 * 4/2008 Kolk ..... 374/1

* cited by examiner

CONTROLLER WITH DYNAMIC TEMPERATURE COMPENSATION

TECHNICAL FIELD

The present invention generally relates to electronic controllers, and more particularly to electronic controllers that have one or more temperature sensitive sensors.

BACKGROUND

Electronic controllers are used to operate, control and/or monitor a wide variety of different devices, appliances and equipment. Some electronic controllers may include electronic components that generate heat when in operation. As electronic controllers frequently include a housing in which the individual electronic components are located, a temperature that is measured within the housing may be greater than the temperature outside the housing. This internal heat generation may or may not be an issue, depending on the specific use of the electronic controller.

An example of an electronic controller that may exhibit internal heating as a result of power dissipation in internal electronic components, and that may be sensitive to such internal heating, is a thermostat. Thermostats are often used to control a wide variety of equipment, such as furnaces, air conditioners, air exchangers, humidifiers and the like.

Thermostats often provide commands to HVAC equipment in accordance with one or more set points, such as temperature and/or humidity set points. These commands may include, for example, instructions for a furnace to turn on or off, an air conditioning unit to turn on or off, a humidifier and/or dehumidifier to turn on or off, or the like.

For controlling temperature, a thermostat may provide commands that are based on a perceived temperature difference between a current temperature set point and a measured temperature. However, the measured temperature is often the temperature inside of the thermostat housing, which is subject to the internal heating as discussed above, and not the temperature in the surrounding space. Likewise, for controlling humidity, a thermostat may provide commands that are based on a perceived humidity difference between a current humidity set point and a measured humidity value. The measured humidity, however, is often the relative humidity inside of the thermostat housing, which is subject to internal heating as discussed above, and not the relative humidity in the surrounding space. As can be seen, such internal heating can create inaccuracies in how the thermostat provides instructions to the HVAC equipment.

SUMMARY

The present invention generally relates to electronic controllers, and more particularly to electronic controllers that have one or more temperature sensitive sensors. More specifically, the present invention relates to electronic controllers that produce internal heating within a housing, and account for such internal heating and in some cases internal transient heating within the housing when determining an environmental condition in a surrounding space.

An illustrative but non-limiting example of the present invention may be found in a method of dynamic temperature compensation within an electronic device. In some instances, the electronic device may be an electronic controller, such as a thermostat or the like. A temperature may be measured within the electronic device, which may in some cases include a housing. A transient heat change may be determined. A corrected temperature may be determined, based at least in part upon the measured temperature and the transient heat change within the housing.

In some cases, determining the transient heat change may be at least partially a function of how long the electronic device has been powered, as in some cases, the temperature within the electronic device may be influenced by the length of time the electronic device has been powered. Determining the transient heat change may, if desired, be at least partially a function of how long the electronic device has been powerless, subsequent to being powered, as in some cases the temperature inside the electronic device may be influenced by the length of time the device has been unpowered.

In some cases, determining the transient heat change may, if desired, be at least partially based upon how long the electronic device has been powerless subsequent to having reached a steady state temperature condition. In yet other cases, the transient heat change may be directly measured over time using, for example, a temperature sensor.

Another illustrative but non-limiting example of the present invention may be found in a method of dynamic temperature compensation in an HVAC controller. A temperature may be measured within the HVAC controller, and a transient heat rise may be calculated. A corrected temperature may be calculated, based upon the measure temperature and the transient heat rise. In some cases, if desired, calculating a transient heat rise may occur repeatedly, at least until the HVAC controller reaches a steady state temperature condition. In some instances, if desired, the HVAC controller may be operated in accordance with the corrected temperature. The corrected temperature may be displayed on a display of the HVAC controller, if desired.

In some instances, the transient heat rise may be based upon a mathematical model. In some cases, if desired, the mathematical model may include a first order time lag. In such cases, the transient heat rise may be calculated using the following formula:

$$HeatRise_{i+1} = HeatRise_i + \left(1 - e^{-\frac{\Delta t}{tau}}\right) * (HeatRise_{SS} - HeatRise_i),$$

in which $HeatRise_{i+1}$ is the transient heat rise, $HeatRise_i$ is a previously calculated transient heat rise, $\Delta t$ represents a time increment since calculating $HeatRise_i$, tau represents a time constant, and $HeatRise_{SS}$ represents a steady state heat rise value. In some particular cases, and for some particular HVAC controllers, $\Delta t$ may be set equal to one. In some cases, tau may be set equal to 45 minutes.

Another illustrative but non-limiting example of the present invention may be found in a method of dynamic temperature compensation in an HVAC controller. A temperature may be measured within the HVAC controller. A transient heat rise may be calculated, and its value may be stored in non-volatile memory. A time parameter indicating a power loss may be stored in non-volatile memory. In some cases, if desired, the time parameter may include a date and/or time stamp that is stored when the transient heat rise value is stored. The most recent date and/or time stamp stored may provide an indication of when power was most recently lost.

A corrected temperature may be calculated, based at least in part upon the transient heat rise and the time parameter. In some cases, calculating a corrected temperature may include adjusting the transient heat rise to account for cooling that may have occurred while the HVAC controller was temporarily unpowered as a result of, for example, a short power outage.

In some cases, the transient heat rise may be calculated using a mathematical model such as a first order time lag. In some instances, if desired, the transient heat rise may be calculated using the following formula:

$$HeatRise_{new} = HeatRise_{old} + \left(1 - e^{-\frac{T}{tau}}\right) * (HeatRise_{SS} - HeatRise_{old}),$$

in which $HeatRise_{new}$ is the transient heat rise, $HeatRise_{old}$ is a transient heat rise value stored before power was lost, T represents a time duration during which the HVAC controller was not powered, tau represents a time constant, and $HeatRise_{SS}$ represents a steady state heat rise value.

Another illustrative but non-limiting example of the present invention may be found in a method of dynamic thermal compensation in an HVAC controller. A parameter may be measured within the HVAC controller, and a parameter correction factor may be calculated. The measured parameter and the parameter correction factor may be used to calculate a corrected parameter value.

In some instances, if desired, measuring a parameter may include measuring a relative humidity within the HVAC controller. The parameter correction factor may, in some situations, be based at least in part upon a temperature or a temperature increase within the HVAC controller.

In some cases, calculating a corrected parameter may include calculating a corrected relative humidity value in accordance with the formula:

$$RH_{actual} = RH_{measured} + (A + B * RH_{measured}) * HeatRise,$$

in which $RH_{actual}$ is the corrected relative humidity value, $RH_{measured}$ is the measured relative humidity value, HeatRise represents a temperature rise inside the HVAC controller and A & B are correction factors relating to a particular HVAC controller. In some particular cases, and for some particular HVAC controllers, A may be set equal to 0.294 and B may be set equal to 0.0294.

Another illustrative but non-limiting example of the present invention may be found in an HVAC controller having a housing. The HVAC controller may be adapted to measure a temperature within the housing. The HVAC controller may be adapted to determine a transient heat change and then to determine a corrected temperature that is based upon the measured temperature and the transient heat change.

In some cases, the HVAC controller may adapted to determine the transient heat change as a function of how long the HVAC controller has been powered. The HVAC controller may, if desired, be adapted to determine the transient heat change as a function of how long the HVAC controller has been powerless subsequent to having been powered.

The above summary of the present invention is not intended to describe each disclosed embodiment or every implementation of the present invention. The Figures, Description and Examples which follow more particularly exemplify these embodiments.

BRIEF DESCRIPTION OF THE FIGURES

The invention may be more completely understood in consideration of the following detailed description of various embodiments of the invention in connection with the accompanying drawings, in which.

Figure 1:
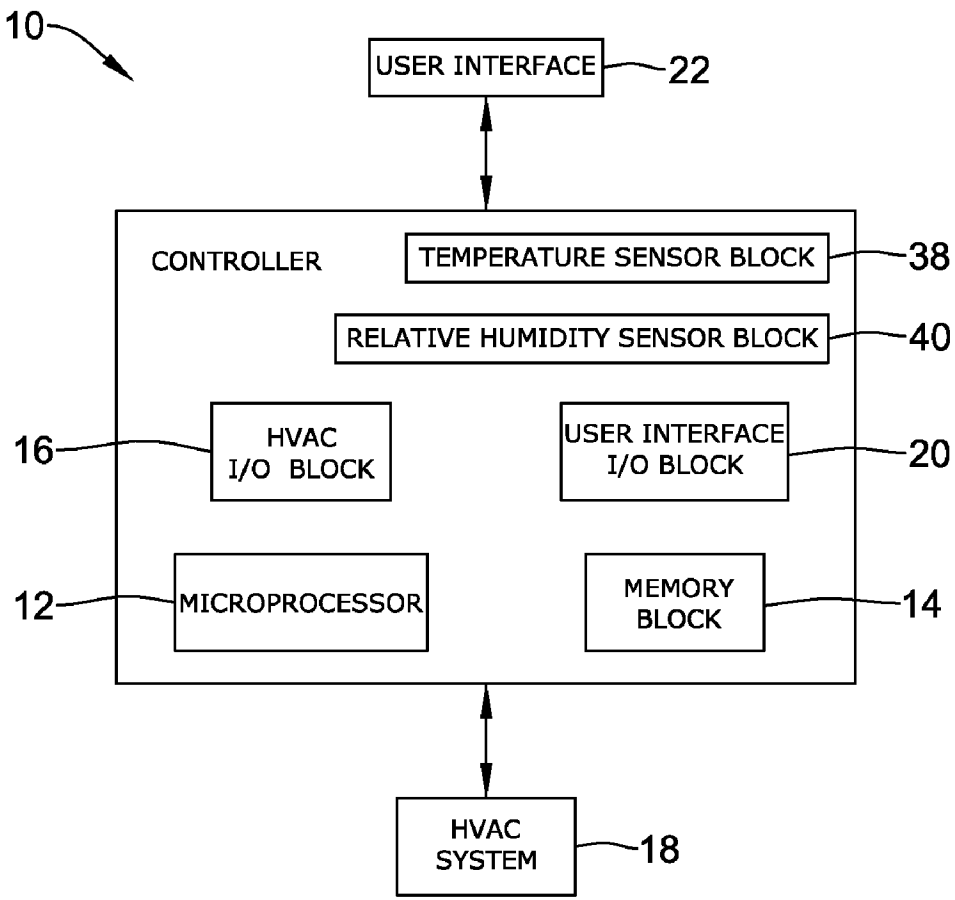
FIG. 1 is a schematic drawing of an HVAC controller in accordance with an illustrative embodiment of the present invention.

While the invention is amenable to various modifications and alternative forms, specifics thereof have been shown by way of example in the drawings and will be described in detail. It should be understood, however, that the intention is not to limit the invention to the particular illustrative embodiments described. On the contrary, the intention is to cover all modifications, equivalents, and alternatives falling within the spirit and scope of the invention.

DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

Generally, the present invention relates to electronic controllers that have one or more temperature sensitive sensors that may be affected by internal heating that is caused from power consumption of components within the electronic controllers. Such electronic controllers can be used to control a variety of systems such as, for example, HVAC systems, sprinkler systems, security systems, lighting systems, and the like. An thermostat is used as an example in the various figures below to help illustrative the present invention. However, it should be recognized that the present invention can be applied to a wide variety of electronic controllers.

Referring now to FIG. 1, which shows an HVAC controller 10 in accordance with one illustrative embodiment of the present invention. Illustrative HVAC controller 10 includes a number of subsystems or components, each having a particular task or set of tasks. For example, HVAC controller 10 includes a microprocessor 12 that is configured to carry out a program contained within HVAC controller 10. Programming may be retained in a memory block 14. Memory block 14 may also be used to store set points and/or other information or data.

The illustrative HVAC controller 10 also includes an HVAC I/O block 16 that is adapted to communicate with an HVAC system 18. HVAC system 18 may include one or more components such as a furnace, boiler, air conditioner, humidifier, de-humidifier, air exchanger, air filtration system, and the like. HVAC I/O block 16 may provide appropriate commands to HVAC system 18, and in some cases, may receive information from HVAC system 18. For example, HVAC system 18 may provide confirmation that a command has been received and implemented, or may provide HVAC controller 10 with information pertaining to the efficiency or operating status of any one or more of the components within HVAC system 18, but this is not required.

The illustrative HVAC controller 10 also includes a user interface block 20 that is adapted to communicate with a user interface 22. User interface 22 may be configured to provide communication between HVAC controller 10 and a user. User interface 22 can be used to, for example, communicate current status of HVAC system 18, a current temperature, a current humidity, and/or accept input from the user. Examples of user inputs that can be received from the user can include changes to one or more program parameters, such as schedule parameters and/or set points, commands to turn particular HVAC equipment on or off, and the like.

User interface 22 can take a wide variety of different forms. For example, user interface 22 can include one or more of an alpha-numeric display, a graphical display, and/or a key pad having one or more keys or buttons. In some embodiments, user interface 22 can include a touch screen. In other embodiments, user interface 22 can include a display screen and one or more buttons, as desired.

Figure 2:
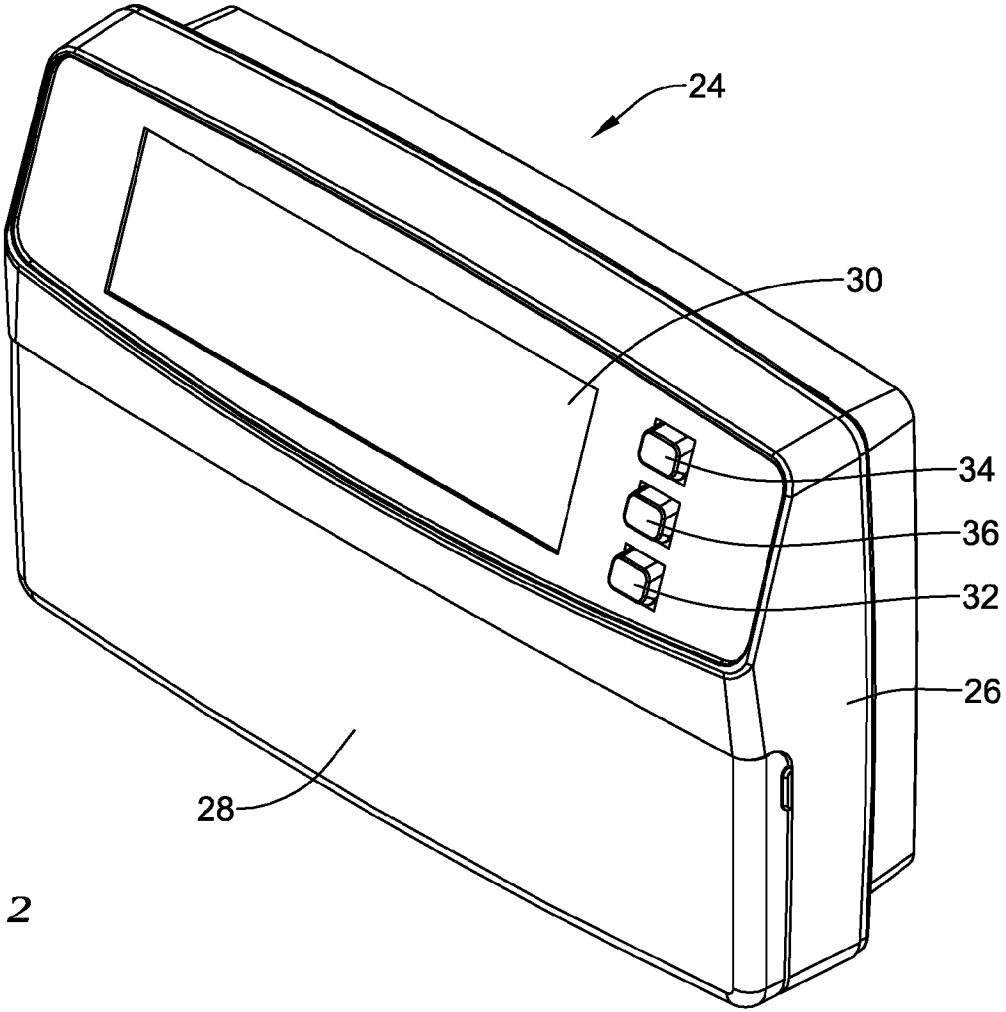
FIG. 2 is a front view of an example HVAC controller in accordance with FIG. 1.

FIG. 2, for example, illustrates an illustrative but non-limiting HVAC controller 24 that includes a housing 26. In some cases, housing 26 may include a flip-down door 28, revealing additional controls, operating instructions, and the like, if desired (not shown). Illustrative HVAC controller 24 may, if desired, include a display 30. Display 30 can be an LED display, an LCD display, or any other suitable display format discernible to the human eye.

In the illustrated embodiment, HVAC controller 24 also includes several buttons. As illustrated, HVAC controller 24 includes a DOWN button 32, an UP button 34 and an INFO button 36. DOWN button 32 and UP button 34 may be used, in combination, to raise or lower any desired parameter. INFO button 36 may be used, for example, to display a particular set point. It should be recognized that the HVAC controller 24 is merely illustrative, and could of course include a greater number of buttons, or even no buttons, if for example display 30 is a touch screen as referenced above.

With reference back to FIG. 1, HVAC controller 10 may include a temperature sensor block 38 that is adapted to communicate with a temperature sensor (not shown). HVAC controller 10 may rely upon a temperature reading by the temperature sensor to determine, for example, what commands to give (through HVAC I/O block 16) to HVAC system 18. HVAC controller 10 may include a temperature sensor such as a thermister, either positioned within HVAC controller 10 (such as within housing 26, FIG. 2) or positioned externally to HVAC controller 10.

In some instances, HVAC controller 10 may also include a relative humidity sensor block 40 that is adapted to communicate with a relative humidity sensor (not shown). In some instances, the programming within HVAC controller 10 may include instructions to alter set points and the like, depending on the relative humidity detected within an environment. In some cases, HVAC system 18 may include a humidifier, dehumidifier, and/or an air exchanger. If a low relative humidity is detected, HVAC controller 10 may instruct HVAC system 18 to activate or turn up a humidifier. Alternatively, if for example the relative humidity is too high, HVAC controller 10 may instruct HVAC system 18 to activate a dehumidifier or activate or speed up an air exchanger.

In some cases, as will be referenced with respect to FIGS. 3 through 8, HVAC controller 10 may be configured to measure a environmental parameter such as a temperature or a relative humidity using a sensor that is exposed to the internal heat generated by the HVAC controller, and then correct the parameter(s) to compensate for the internal heating to generate a more accurate representation of the actual temperature, humidity or other environmental parameter in the space surrounding the HVAC controller 10. In some cases, the sensor may be located within the housing of the HVAC controller 10. Memory block 14 (FIG. 1) may include formulae, equations, look-up tables and/or the like, which may be used by microprocessor 12 (FIG. 1) to make the appropriate determinations, calculations and corrections.

In some cases, and with respect to adjusting a measured temperature, HVAC controller 10 may determine a transient heat change that is at least partially a function of how long the HVAC controller 10 has been powered up. In some instances, the transient heat change may be at least partially a function of how long the HVAC controller 10 has been powerless subsequent to having been powered, or even how long HVAC controller 10 has been powerless subsequent to having reached a powered steady state temperature condition.

In some instances, if desired, a transient heat rise may be calculated in accordance with a mathematical model. A mathematical model may be theoretical, or may, for example, be the result of curve-fitting experimental data. In some cases, the internal heat generation within HVAC controller 10 (FIG. 1) at or near a sensor may be modeled using a first order time lag. In such cases, the transient heat rise may be determined using the following formula:

$$HeatRise_{i+1} = HeatRise_i + \left(1 - e^{-\frac{\Delta t}{tau}}\right) * (HeatRise_{SS} - HeatRise_i).$$

In this formula, $HeatRise_{i+1}$ is the transient heat rise that is being determined, and $HeatRise_i$ is a previously calculated transient heat rise. $\Delta t$ represents the time increment between when $HeatRise_i$ was calculated and when $HeatRise_{i+1}$ is being calculated. Tau represents a time constant representative of the heating characteristics of HVAC controller 10 (FIG. 1), while $HeatRise_{SS}$ represents a steady state heat rise value. Finally, e represents the base of the natural logarithms, and has a numerical value of about 2.71828.

In particular cases, and with respect to a particular HVAC controller 10 (FIG. 1), $\Delta t$ may be set equal to one minute and tau may be set equal to forty five minutes. It should be recognized, however, that these values are only illustrative, and may be varied to accommodate the specific configuration of a particular electronic controller.

It should be recognized that the formula given above pertains to calculating incremental temperature increases as HVAC controller (FIG. 1) warms up after power is applied. In some cases, such as when HVAC controller 10 suffers a temporary power loss, either while warming up or after having reached an internal temperature steady state, it may be desirable to calculate a new heat rise value once power is restored. As with the previous case, this calculation may be based on a theoretical model, experimentation, or some combination thereof. In some cases, a transient heat rise may be calculated using the following formula:

$$HeatRise_{new} = HeatRise_{old} + \left(1 - e^{-\frac{T}{tau}}\right) * (HeatRise_{SS} - HeatRise_{old}).$$

In this formula, $HeatRise_{new}$ is the transient heat rise value adjusted for the cooling-off period and $HeatRise_{old}$ is the transient heat rise value stored before power was lost. T represents a time duration during which the HVAC controller was not powered, tau represents a time constant, $HeatRise_{SS}$ represents a steady state heat rise value and e is as defined above.

In some cases, the value provided by a relatively humidity sensor may be temperature sensitive. With respect to adjusting a measured relative humidity value, HVAC controller 10 (FIG. 1) may determine an adjusted relative humidity based upon a mathematical model, experimental data, or some combination thereof. For example, a theoretical model may provide a starting point, from which experimental data may provide adjustments to the theoretical model. In some instances, if desired, a corrected relative humidity value may be calculated in accordance with the formula:

$$RH_{actual}=RH_{measured}+(A+B*RH_{measured})*HeatRise.$$

In this formula, $RH_{actual}$ is the corrected relative humidity value and $RH_{measured}$ is the measured relative humidity value. HeatRise represents a temperature rise inside the HVAC controller, which may be calculated using the formulae discussed above, depending on whether HVAC controller 10 has remained powered, has been unpowered, etc. A & B are correction factors relating to a particular HVAC controller configuration.

A & B may be varied to accommodate the specifics of a particular HVAC controller. It is contemplated that A may vary, for example, from about 0.1 to about 0.5, and B may vary from about 0.01 to about 0.05. In particular cases, and with respect to a particular HVAC controller 10 (FIG. 1), A may be set equal to 0.294 and B may be set equal to 0.0294. It should be recognized, however, that these values may be varied to accommodate the specific configuration of a particular electronic controller, as desired.

Figure 3:
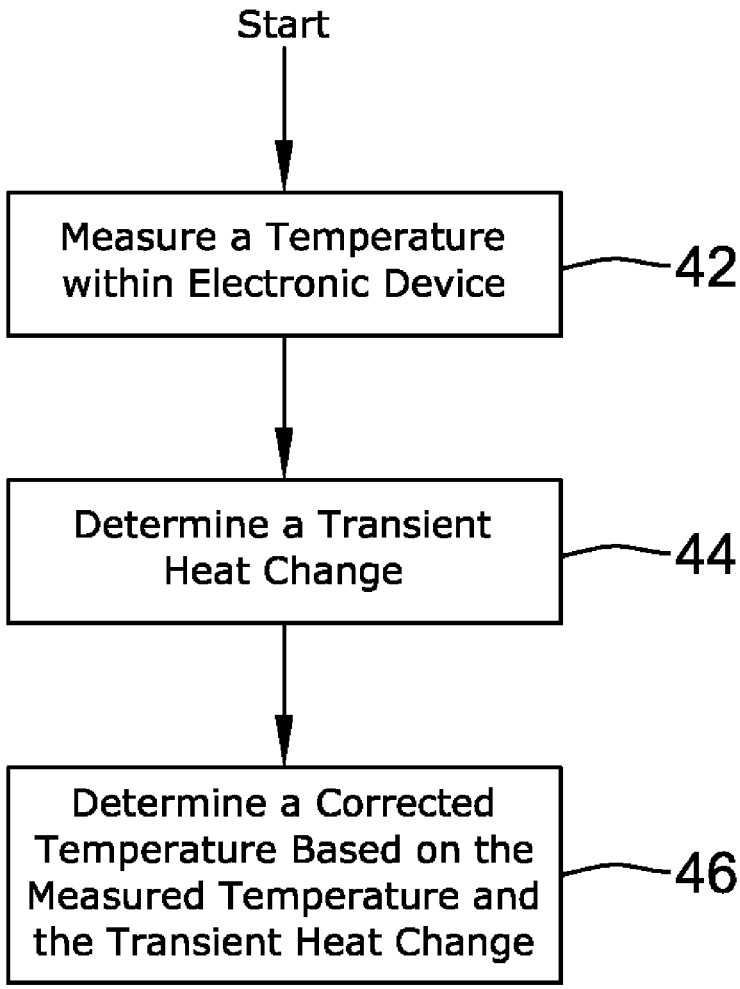
FIG. 3 is a flow diagram showing an illustrative method that may be carried out by the illustrative HVAC controller of FIG. 1.

Turning now to FIG. 3, which is a flow diagram showing an illustrative method that may be carried out by the illustrative HVAC controller of FIG. 1. Control starts at block 42, where a temperature is measured within the housing of an electronic controller (such as HVAC controller 10 of FIG. 1) using any suitable temperature sensor or temperature detection structure or apparatus. At block 44, a transient heat change is determined, using any suitable method such as those discussed above. A heat change may be positive, if the electronic controller is heating up, or it may be negative if the electronic controller is cooling off as a result of a power outage. At block 46, a corrected temperature is determined that is based on the measured temperature and the transient heat change. In some instances, this may be achieved by adding or subtracting a heat change value from the measured temperature.

It should be noted that while the flow diagram in FIG. 3 only shows a single temperature measurement, a single transient heat change determination and a single corrected temperature determination, it is contemplated that these steps may be carried out a number of times.

Figure 4:
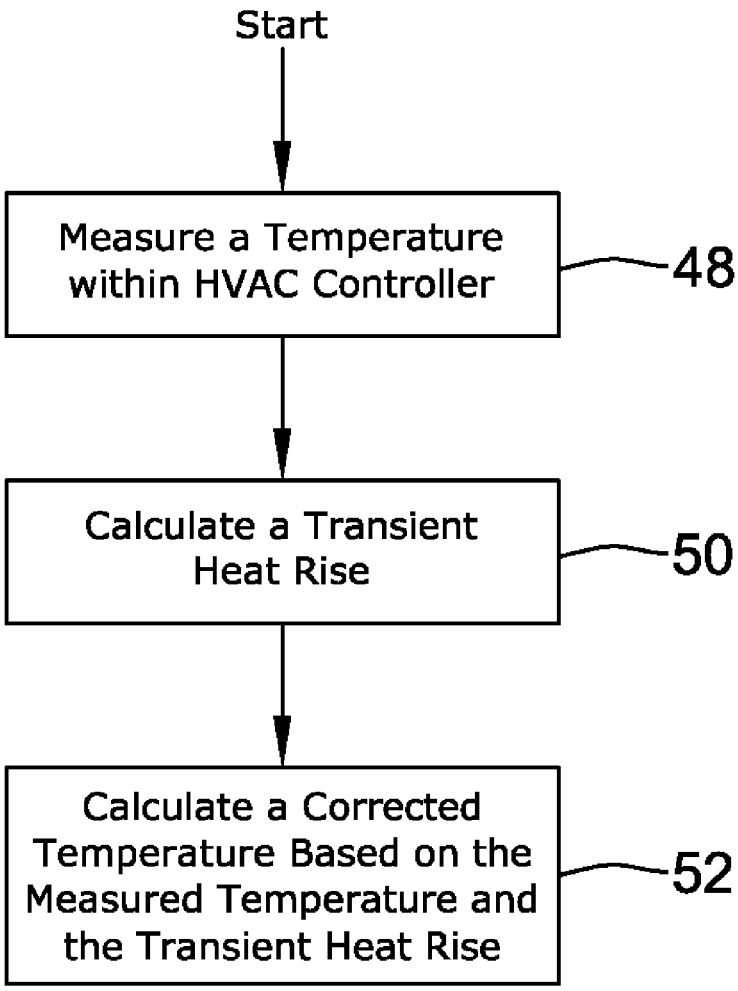
FIG. 4 is a flow diagram showing an illustrative method that may be carried out by the illustrative HVAC controller of FIG. 1.

FIG. 4 shows an illustrative but non-limiting method that may be carried out by HVAC controller 10 (FIG. 1). At block 48, a temperature is measured within the housing of HVAC controller 10, perhaps through cooperation with a temperature sensor or temperature detecting structure or apparatus (not shown) and temperature sensor block 38 (FIG. 1). At block 50, a transient heat rise is determined, using any suitable method such as those discussed above. In some cases, a measure of the transient heat rise may be determined using, among other things, two or more temperature sensor readings taken over time. At block 52, a corrected temperature is determined that is based on the measured temperature and the transient heat rise. In some instances, this may be achieved by adding or subtracting a heat rise value to the measured temperature.

Figure 5:
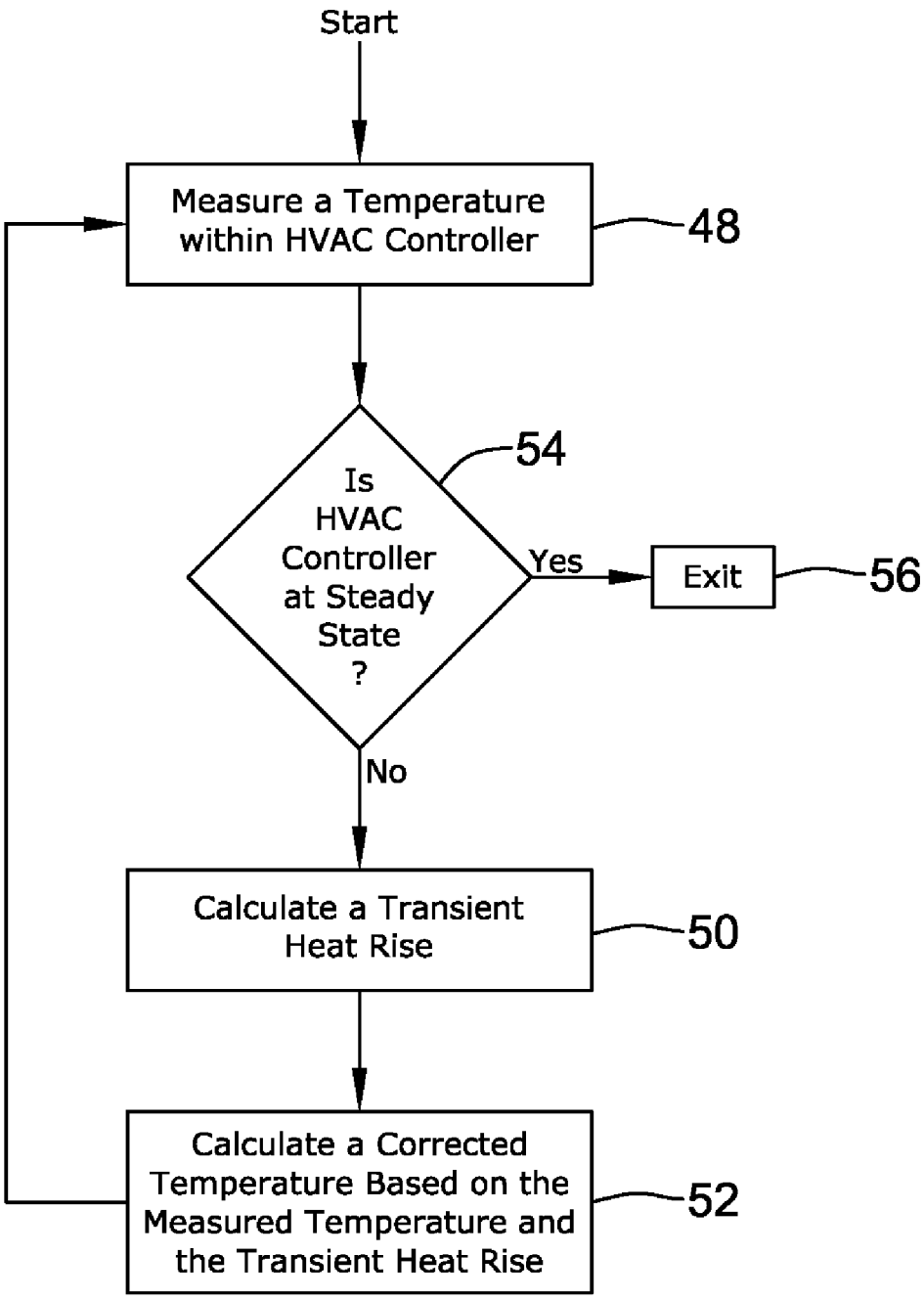
FIG. 5 is a flow diagram showing an illustrative method that may be carried out by the illustrative HVAC controller of FIG. 1.

FIG. 5 shows an illustrative but non-limiting method that may be carried out by HVAC controller 10 (FIG. 1). At block 48, a temperature is measured within the housing of HVAC controller 10, perhaps through cooperation between a temperature sensor or temperature detecting structure or apparatus (not shown) and temperature sensor block 38 (FIG. 1).

At decision block 54, HVAC controller 10 determines whether or not HVAC controller 10 is in a steady state temperature condition. This may be determined in several ways. For example, if the measured temperature remains relatively constant over a period of time, HVAC controller 10 may be deemed to be in a steady state temperature condition. Likewise, if a transient heat rise (change in temperature divided by change in time) remains relatively constant at or near zero, HVAC controller 10 may be deemed to be in a steady state temperature condition. If HVAC controller 10 is in a steady state temperature condition, control passes to block 56, at which point HVAC controller 10 may not need to further make transient corrections to the measured temperature value for the HVAC controller 10.

However, if HVAC controller 10 (FIG. 1) is not in a steady state temperature condition, control passes to block 50, where HVAC controller 10 calculates a transient heat rise as discussed above. At block 52, a corrected temperature is determined that is based on the measured temperature and the transient heat rise, as discussed above.

Figure 6:
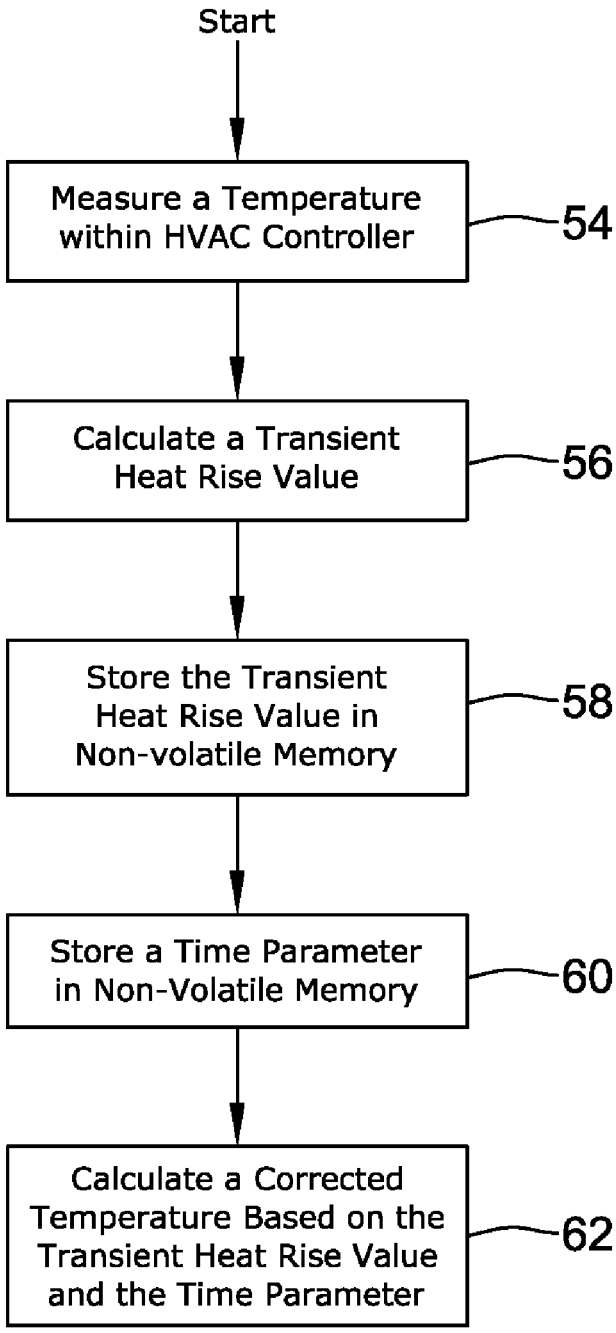
FIG. 6 is a flow diagram showing an illustrative method that may be carried out by the illustrative HVAC controller of FIG. 1.

FIG. 6 shows an illustrative but non-limiting method that may be carried out by HVAC controller 10 (FIG. 1). At block 54, HVAC controller 10 measures a temperature within the housing of HVAC controller 10, perhaps through cooperation between a temperature sensor or temperature detecting structure or apparatus (not shown) and temperature sensor block 38 (FIG. 1). At block 56, HVAC controller 10 calculates a transient heat rise value as discussed above.

Control passes to block 58, where the transient heat rise value is stored in non-volatile memory. It is considered that memory block 14 (FIG. 1) may include non-volatile memory that retains data even when power is lost. At block 60, a time parameter is stored in non-volatile memory. The time parameter may include a date and/or time stamp that corresponds to when the transient heat rise value was calculated at block 56 and/or stored in non-volatile memory at block 58.

At block 62, a corrected temperature may be calculated using the transient heat rise value and the time parameter. In some instances, this may be achieved using the formula given above, that adjusts the heat rise value for the period of time HVAC controller 10 (FIG. 1) was powerless, and therefore cooling off.

Figure 7:
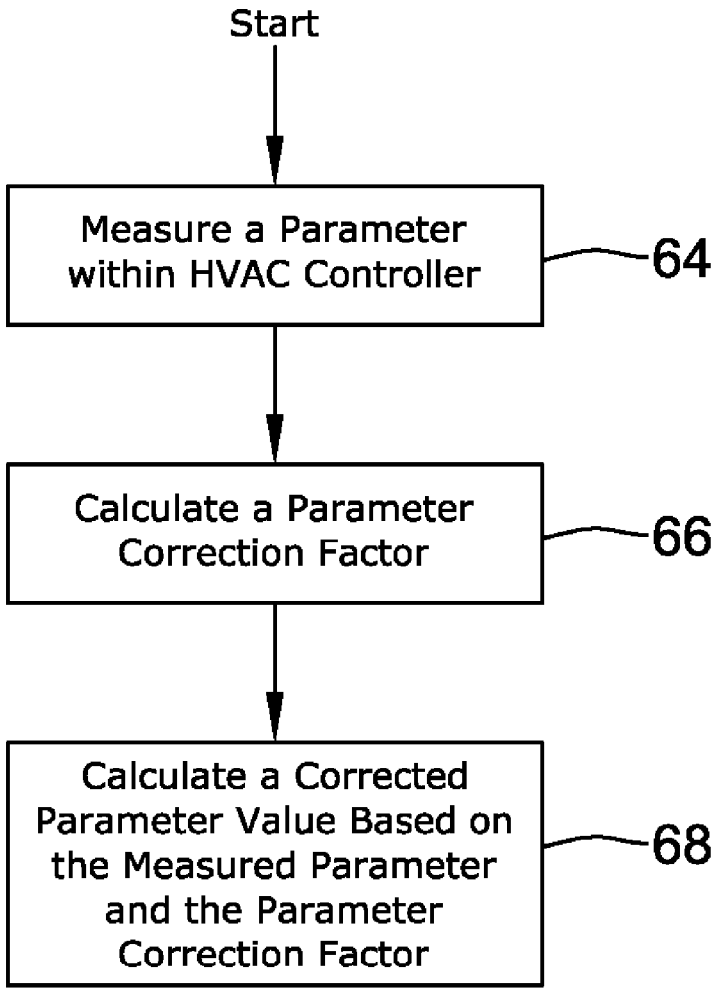
FIG. 7 is a flow diagram showing an illustrative method that may be carried out by the illustrative HVAC controller of FIG. 1.

FIG. 7 shows an illustrative but non-limiting method that may be carried out by HVAC controller 10 (FIG. 1). At block 64, an environmental parameter is measured within the housing of the HVAC controller 10. The parameter measured may be any desired parameter, such as, for example, temperature and/or relative humidity. Control passes to block 66, where a parameter correction factor is calculated. This may be accomplished using any suitable mathematical or experimental model. Illustrative calculations for determining a correction factor are described above with respect to, for example, temperature and relative humidity.

At block 68, HVAC controller 10 calculates a corrected parameter value based upon the measured parameter and the correction factor. It should be noted that while the flow diagram in FIG. 7 only shows a single parameter measurement, a single parameter correction factor calculation and a single corrected parameter calculation, it is contemplated that these steps may be carried out a number of times.

Figure 8:
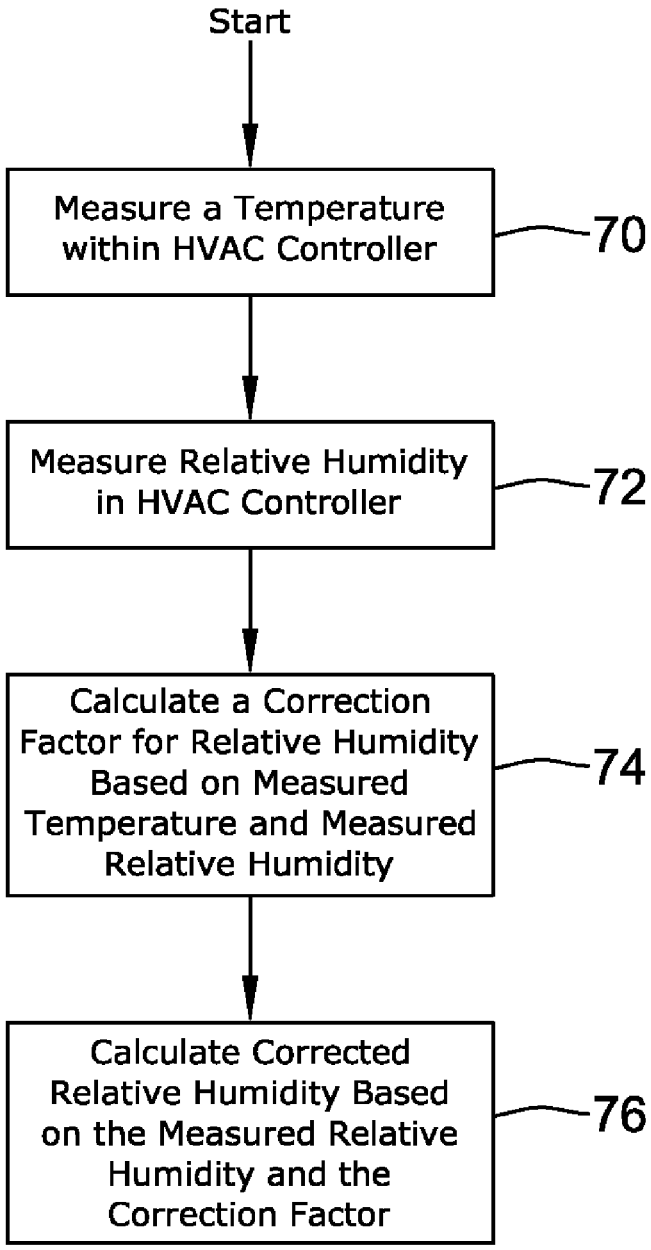
FIG. 8 is a flow diagram showing an illustrative method that may be carried out by the illustrative HVAC controller of FIG. 1.

FIG. 8 shows an illustrative but non-limiting method that may be carried out by HVAC controller 10 (FIG. 1). At block 70, a temperature within the housing of HVAC controller 10 is measured, perhaps through cooperation between a temperature sensor or temperature detecting structure or apparatus (not shown) and temperature sensor block 38 (FIG. 1). At block 72, a relative humidity within HVAC controller 10 is measured, such as through cooperation between a humidistat or other humidity sensor (not shown) and relative humidity sensor block 40 (FIG. 1).

Control passes to block 74, where HVAC controller 10 (FIG. 1) calculates a correction factor for the measured relative humidity value. This calculation may, for example, be based at least in part upon the measured temperature and the measured relative humidity, as discussed above. At block 76, HVAC controller calculates a corrected relative humidity value based on the measured relative humidity and the correction factor.

It should be noted that while the flow diagram in FIG. 8 only shows a single temperature measurement, a single relative humidity measurement, a single correction factor calculation and a single corrected relative humidity calculation, it is contemplated that these steps may be carried out a number of times.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

We claim:

1. A method of dynamic temperature compensation in an HVAC controller, the method comprising the steps of:

measuring a temperature within the HVAC controller;

determining a temperature offset, wherein the temperature offset is a function of time since the HVAC controller was most recently powered up;

determining a corrected temperature as a function of time based on the measured temperature and the temperature offset; and operating the HVAC controller in accordance with the corrected temperature.

2. The method of claim 1, wherein determining the temperature offset is a function of how long the HVAC controller was powerless subsequent to a previous time period where the HVAC controller was powered up.

3. The method of claim 1, wherein determining the temperature offset is a function of how long the HVAC controller was powerless subsequent to having been powered up during a previous time period for a sufficient time to reach a steady state temperature condition.

4. The method of claim 1, wherein the HVAC controller comprises a housing, and the measuring step occurs within the housing.

5. The method of claim 1, wherein the temperature offset does not decrease with respect to time while the HVAC controller remains continuously powered up.

6. A method of dynamic temperature compensation in an HVAC controller having a housing, the HVAC controller being capable of selectively providing a control signal to an HVAC unit, the method comprising the steps of:

measuring a temperature within the housing of the HVAC controller;

calculating a transient heat rise independent of the control signal that is selectively provided to the HVAC unit;

calculating a corrected temperature based on the measured temperature and the transient heat rise; and operating the HVAC controller in accordance with the corrected temperature.

7. The method of claim 6, wherein the step of calculating a transient heat rise is carried out repeatedly at least until the HVAC controller reaches a steady state temperature condition.

8. The method of claim 6, wherein calculating a transient heat rise comprises calculating a transient heat rise based upon a mathematical model.

9. The method of claim 6, wherein the transient heat rise is calculated using the following formula:

$$HeatRise_{i+1} = HeatRise_i + \left(1 - e^{-\frac{\Delta t}{tau}}\right) * (HeatRise_{SS} - HeatRise_i),$$

where:

$HeatRise_{i+1}$ is the transient heat rise;

$HeatRise_i$ is a previously calculated transient heat rise;

$\Delta t$ represents a time increment since calculating $HeatRise_i$;

tau represents a time constant; and $HeatRise_{SS}$ represents a steady state heat rise value.

10. The method of claim 9, wherein $\Delta t$ is set equal to one second.

11. The method of claim 10, wherein tau is set equal to 45 minutes.

12. The method of claim 6, further comprising a step of displaying the corrected temperature.

13. A method of dynamic temperature compensation in an HVAC controller having a housing, the method comprising the steps of:

measuring a temperature within the housing of the HVAC controller;

calculating a transient heat rise while the HVAC controller is powered prior to a loss of power to the HVAC controller;

storing in a non-volatile memory the transient heat rise;

storing in the non-volatile memory a time parameter indicating when power is lost;

after a resumption of power to the HVAC controller, calculating a decayed heat rise based upon the transient heat rise and time parameter stored in the non-volatile memory;

calculating a corrected temperature based upon the decayed heat rise; and operating the HVAC controller in accordance with the corrected temperature.

14. The method of claim 13, wherein calculating a transient heat rise comprises calculating a transient heat rise based upon a mathematical model.

15. The method of claim 13, wherein the time parameter comprises a date and/or time stamp stored when the transient heat rise value is stored.

16. The method of claim 13, wherein calculating the decayed heat rise comprises adjusting the transient heat rise to account for cooling while power is lost.

17. The method of claim 13, wherein the decayed heat rise is calculated using the following formula:

$$HeatRise_{new} = HeatRise_{old} + \left(1 - e^{-\frac{T}{tau}}\right) * (HeatRise_{SS} - HeatRise_{old}),$$

where:

$HeatRise_{new}$ is the decayed heat rise;

$HeatRise_{old}$ is the transient heat rise stored before the loss of power;

T represents a time duration during which the HVAC controller was not powered;

tau represents a time constant; and $HeatRise_{SS}$ represents a steady state heat rise value.

18. A method of dynamic thermal compensation in an HVAC controller, the method comprising the steps of:

measuring a parameter within the HVAC controller;

calculating a parameter correction factor, wherein the parameter correction factor is a function of time since the HVAC controller was most recently powered up;

calculating a corrected parameter value based on the measured parameter and the parameter correction factor; and operating the HVAC controller in accordance with the corrected parameter.

19. The method of claim 18, wherein the measuring step comprises measuring a relative humidity within the HVAC controller.

20. The method of claim 19, wherein the calculating a parameter correction factor is based at least in part upon a temperature within the HVAC controller.

21. The method of claim 19, wherein the step of calculating a corrected parameter value comprises calculating a corrected relative humidity value in accordance with the formula:

$$RH_{actual} = RH_{measured} + (A + B * RH_{measured}) * HeatRise,$$

where:

$RH_{actual}$ is the corrected relative humidity value;

$RH_{measured}$ is the measured relative humidity value;

HeatRise represents a temperature rise inside the HVAC controller; and

A & B are correction factors relating to a particular HVAC controller.

22. The method of claim 21, wherein A is set equal to 0.294 and B is set equal to 0.0294.

23. An HVAC controller having a housing, the HVAC controller configured to:

measure a temperature within the housing;

determine a transient heat change, wherein the transient heat change is a function of how long the HVAC controller has been powered up; and determine a corrected temperature based on the measured temperature and the transient heat change.

24. The HVAC controller of claim 23, wherein the HVAC controller is configured to determine the transient heat change as a function of how long the HVAC controller was powerless subsequent to a previous time period where the HVAC controller was powered up.

* * * * *